US009550107B1

(12) United States Patent
Shannon, II

(10) Patent No.: US 9,550,107 B1
(45) Date of Patent: Jan. 24, 2017

(54) SYSTEM FOR GUIDING AN APPARATUS OVER A SURFACE

(71) Applicant: Walter D. Shannon, II, Kinston, NC (US)

(72) Inventor: Walter D. Shannon, II, Kinston, NC (US)

( * ) Notice: Subject to any disclaimer, the term of this patent is extended or adjusted under 35 U.S.C. 154(b) by 0 days.

(21) Appl. No.: 14/958,760

(22) Filed: Dec. 3, 2015

(51) Int. Cl.
*A63C 5/06* (2006.01)
*A63C 5/03* (2006.01)

(52) U.S. Cl.
CPC .. *A63C 5/06* (2013.01); *A63C 5/03* (2013.01)

(58) Field of Classification Search
CPC ..... A63C 5/03; A63C 5/031; A63C 5/06
USPC ..... 280/11.15, 613, 618, 14.21, 14.22, 14.24
See application file for complete search history.

(56) References Cited

U.S. PATENT DOCUMENTS

| | | | | |
|---|---|---|---|---|
| 4,725,069 | A * | 2/1988 | Stampacchia | A63C 5/031 280/11.28 |
| 5,411,282 | A * | 5/1995 | Shannon | A63C 5/031 280/14.24 |
| 5,618,051 | A * | 4/1997 | Kobylenski | A63C 5/02 280/14.21 |
| 5,799,956 | A * | 9/1998 | Shannon | A63C 5/031 280/14.21 |
| 7,159,875 | B2 * | 1/2007 | Seymour | A63C 5/02 280/11.18 |
| 2007/0024028 | A1 * | 2/2007 | Dekker | A63C 5/03 280/603 |

* cited by examiner

*Primary Examiner* — John Walters
(74) *Attorney, Agent, or Firm* — Christensen O'Connor Johnson Kindness PLLC

(57) ABSTRACT

An apparatus for sliding/gliding on a surface includes a long board and a short board connected to the long board through a hitch beam. The short board is connected to the hitch beam through an axle placed at an angle on the short board, and the long board is connected to the hitch beam through a stationary, non-rotating connection. A turn plate on the long board is connected to the short board so that as the turn plate rotates relative to the long board, the short board can be turned simultaneously with the lifting the lateral inside edge.

25 Claims, 5 Drawing Sheets

SYSTEM FOR GUIDING AN APPARATUS OVER A SURFACE

BACKGROUND

Conventional snowboards have a certain degree of flexing ability and an inward curvature along the sides to enable turning. When using a snowboard, the rider shifts one's weight from one side of the board to the other in order to execute a turn in the desired direction. The radius of a turn with a snowboard is based on the flex and the radius of the side curvature of the snowboard. However, there is a limit to how much flex and curvature a snowboard can have.

Therefore, it would be advantageous to provide an apparatus that can assist a snowboard rider in executing turns.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In some embodiments, an apparatus for sliding on a surface comprises a long board, a short board connected to the long board through a hitch beam, wherein the short board is connected to the hitch beam through an axle placed at an angle on the short board, and the long board is connected to the hitch beam through a stationary, non-rotating connection, and the apparatus has a turn plate on the long board, wherein the turn plate is connected to the short board, and the turn plate rotates on the upper surface of the long board causing a corresponding rotation of the short board.

In some embodiments, the apparatus has a turn plate that is horizontal to an upper surface of the long board.

In some embodiments, the apparatus has a long board that is about 3 times the length of the short board.

In some embodiments, the apparatus comprises a long board that is about the same length as the short board.

In some embodiments, the apparatus further comprises a turn axle connecting the turn plate to the long board.

In some embodiments, the apparatus further comprises a hold down connection on each lateral side of the turn axle.

In some embodiments, the apparatus further comprises a sector groove for each hold down connection, wherein the hold down connection is engaged with the sector groove.

In some embodiments, the apparatus further comprises a first tie rod and a second tie rod that connect the turn plate to the short board.

In some embodiments, the apparatus further comprises a first and second stanchion on the turn plate and a third and fourth stanchion on the short board, wherein the first tie rod is connected to the first and third stanchions, and the second tie rod is connected to the second and fourth stanchions.

In some embodiments, the apparatus has a short board comprising a leading end having a shallow outward protruding keel shape or spoon shape on the underside thereof. In some embodiments, the apparatus has a long board that has a waist narrower than a leading section and a trailing section of the long board.

In some embodiments, the apparatus has a short board that has a waist narrower than a leading section and a trailing section of the short board.

In some embodiments, the apparatus further comprises a boot binding connected to the turn plate.

In some embodiments, rotation of the short board has a rotation component on a longitudinal axis and a rotation component on a vertical axis.

In some embodiments, the magnitude of the rotation component in the longitudinal axis is dependent on the angle of the axle on the short board.

In some embodiments, the apparatus has an axle that is placed at an angle from 15 degrees to 45 degrees from vertical, and the axle is tilted back and along a longitudinal axis of the short board.

In some embodiments, the apparatus has an axle that is not tilted laterally from the longitudinal axis of the short board.

In some embodiments, the apparatus has a hitch beam that is connected at a trailing side of the long board, and the hitch beam is connected to a leading side of the short board.

In some embodiments, the apparatus has clockwise rotation of the short board around the axle to lift a clockwise leading lateral edge of the short board.

In some embodiments, the apparatus has counterclockwise rotation of the short board around the axle to lift a counter clockwise leading lateral edge of the short board.

In some embodiments, a method of executing a turn on a sliding apparatus comprising a long board attached to a short board comprises, during executing of a turn on the apparatus, mechanically rotating the short board and mechanically lifting a lateral inside edge of the short board.

In some embodiments, the method includes clockwise rotation of the short board to lift a clockwise leading lateral edge of the short board.

In some embodiments, the method includes counterclockwise rotation of the short board to lift a counter clockwise leading lateral edge of the short board.

In some embodiments, the method includes, during executing of a turn, the long board is not caused to mechanically rotate horizontally.

In some embodiments, the method includes, during executing of a turn, no long board edge is caused to mechanically lift.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
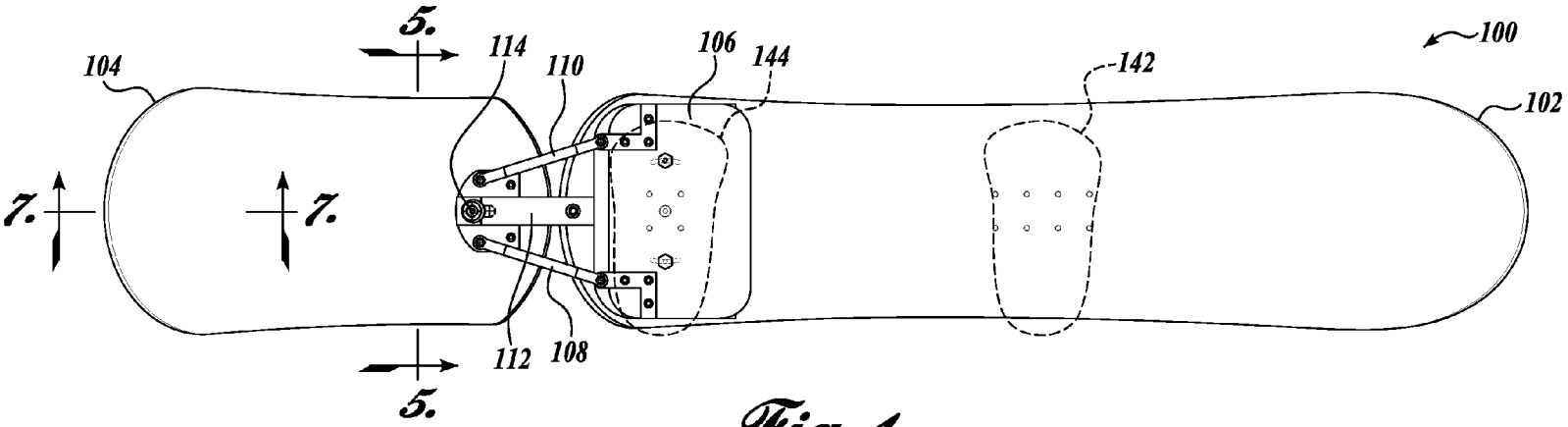
FIG. 1 is an illustration of a sliding apparatus having a long board and a short board.

FIG. 1 illustrates a sliding or gliding apparatus 100 including a first long board 102 connected to a second short board 104. Conventionally, an apparatus for sliding/gliding on snow is referred to as a snowboard. However, the present disclosure can have applications for sliding on other surfaces as well. It should also be appreciated that the board apparatus illustrated in the figures omits showing other accessories, such as bindings. In actual use, however, the apparatus may require bindings for boots, for example. Boot bindings for snowboards are known and generally have length-adjustable straps to hold a boot to the binding and snowboard.

In some embodiments of the apparatus 100, the long board 102 is about three times the length of the short board 104. However, other length ratios may be used. In some embodiments of the apparatus 100, the long board 102 is about two times the length of the short board 104. In some embodiments of the apparatus 100, the long board 102 is about the same length as the short board 104. The thickness of the long board 102 and the short board 104 are generally the thickness of conventional snowboards. In some embodiments, the long board 102 may have an inward side curvature on both lateral sides of the board to define a narrow waist in the center of the board. In some embodiments, the short board 104 may have an inward curvature on both lateral sides of the board to define a narrow waist at the center of the short board 104.

The long board 102 and the short board 104 may be fabricated using conventional methods and materials. For example, the long board 102 and the short board 104 may be fabricated from laminated fiberglass. Woven fiberglass or chopped mat fiberglass may be combined with resins, such as polyester and epoxies. Interior core materials may be added to strengthen or tailor the flex characteristics. Core materials may also be incorporated to provide a sturdy attachment for the bindings 142 and 144 (shown in phantom). Additionally, metal edges along the lateral sides and metal tips at the ends may be incorporated into the long board 102 and the short board 104 for durability and biting into snow and ice. The long board 102 and the short board 104 may be finished with a top coat with designs or graphics for aesthetics.

For description purposes, the long board 102 will be described as the leading board or the front board, while the short board 104 will be described as the trailing board or the rear board. However, in some embodiments, the short board 104 can be the leading board and the trailing board can be the long board 102. FIG. 1 shows one embodiment where the trailing end of the long board 102 is connected to the leading end of the short board 104.

Figure 3:
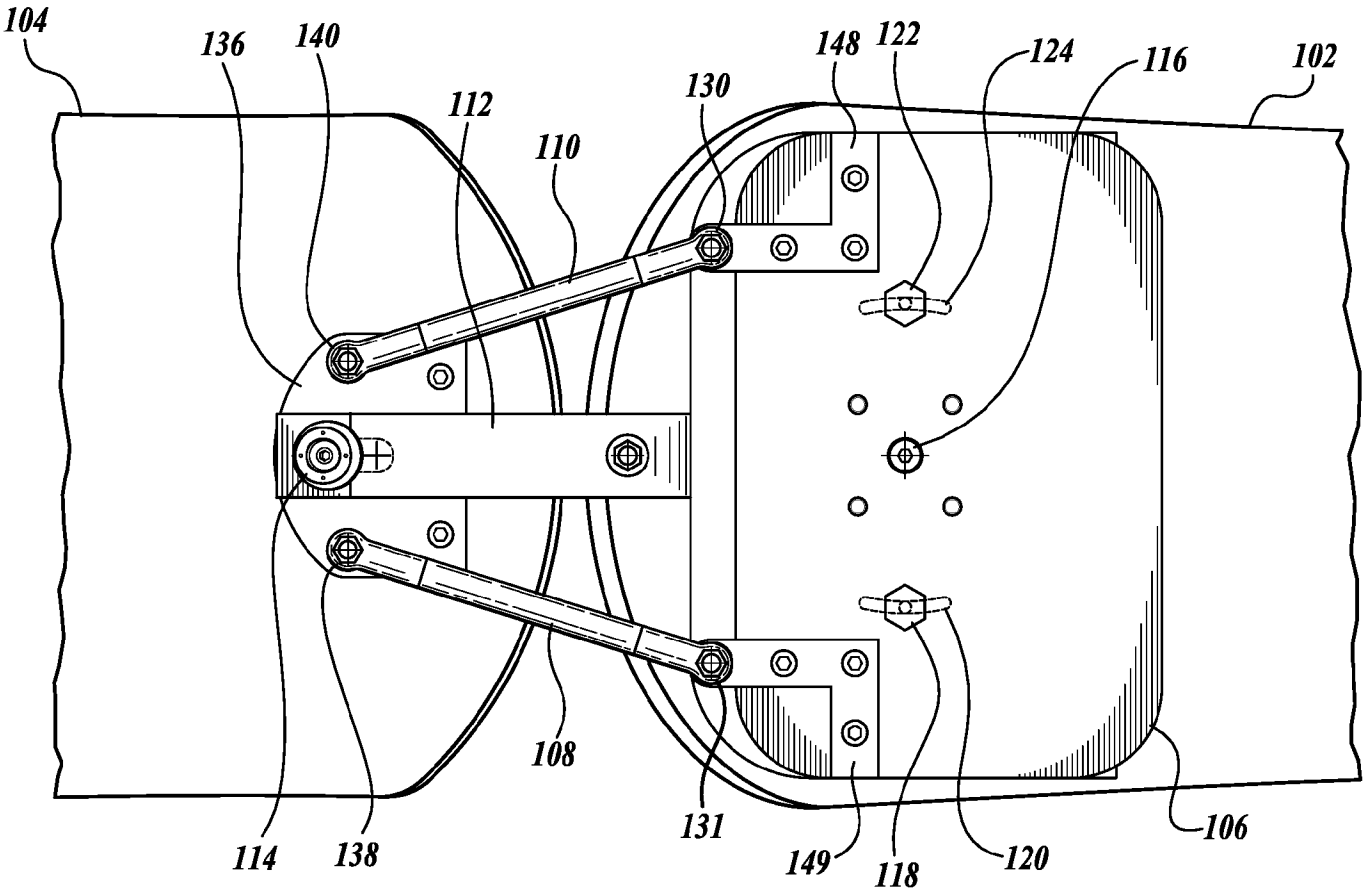
FIG. 3 is an illustration of a connection between the long board and the short board of the sliding apparatus of FIG. 1.

Referring to FIG. 3, an illustration showing one embodiment of the connection between the long board 102 to the short board 104 is provided. The connection 112 or hitch beam 112 is attached through a rotating axle 114 at the short board 104, and the hitch beam 112 is attached through a stationary, non-rotating connector to the long board 102. Thus, the short board 104 is allowed to turn at the axle 114; however, the long board 102 has no axle attachment to the hitch beam 112.

In some embodiments, the trailing end of the long board 102 is provided with a turn base 103. The turn base 103 may be about as thick as the long board 102 and has a width that can extend to or near the lateral sides of the long board 102, but is generally no longer or at least as long as the width of the board. The turn base 103 may be made from fiberglass/resin, metal, or wood, or other material. The turn base 103 may be glassed into the long board 102. However, the turn base 103 may also be attached to the long board 102 via an adhesive or with mechanical fasteners, such as screws or rivets. In some embodiments, the turn base 103 is fabricated integrally with the long board 102. The turn base 103 is used to support a center turn axle 116, and two hold down bolts 118 and 122.

A turn plate 106 is connected to the turn base 103 through the center axle 116. The center axle 116 is positioned at the longitudinal centerline of the long board 102 and is aligned longitudinally with the hitch beam 112. The turn plate 106 is planar and is generally about the same dimensions as the turn base 103. The axle 116 is any combination of elements that can enable rotation of the turn plate 106 with respect to the turn base 103. For example, the axle 116 can simply be a screw secured to the turn base 103, but allows the turn plate 106 to rotate around the screw. The axle 116 may be a sleeve bearing and shaft, or the axle 116 may have rolling elements, such as ball bearings. In any case, the turn plate 106 is attached to the base 103 in a manner that allows rotation of the turn plate 106 in the horizontal plane. The turn plate 106 is attached generally horizontal to the upper surface of the long board 102 and turn base 103. The thickness of the turn plate 106 is sufficient to provide rigidity to support a boot binding and the weight of the rider, for example. Two hold down bolts 118 and 122 are provided equidistant from the center axle 116 on opposite lateral sides of the center axle 116. The turn base 103 has sector grooves 120 and 124, respectively, for engaging the hold down bolts 118 and 122. Sector grooves 120 and 124 are grooves that extend for a section of a circumference about center axle 116. In some embodiments, the hold down bolts 118 and 122 can include a shaft with a head on both ends. The shafts can pass through the sector grooves 120 and 124, while a head is retained in a larger groove on the turn base 103, and the opposite head on the shaft retains the upper surface of the turn plate 106. In this manner, the turn plate 106 is allowed to rotate without the turn plate 106 flexing upwards at the lateral sides from the weight transfer from the rider. Other configurations for holding the lateral sides of the turn base 103 to prevent it from flexing upwards may be envisaged, such as rails on the sides of the turn plate 106 engaging with counterpart rails on the turn base 103. In addition, other configurations for turning the turn plate 106 on the turn base 103 may be envisaged. For example, the turn plate 106 can be connected to the turn base 103 via a turntable bearing or a lazy susan bearing.

Figure 5:
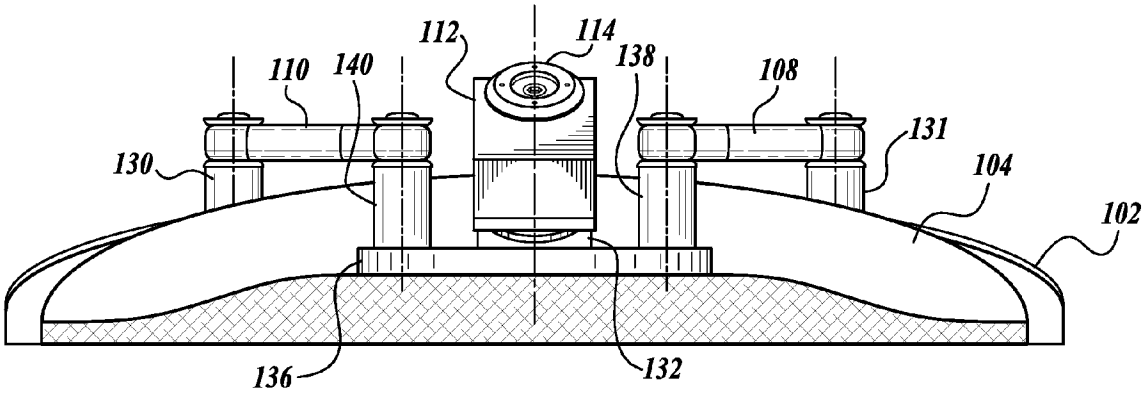
FIG. 5 is a cross-sectional illustration of the sliding apparatus of FIG. 1 taken along lines 5-5 thereof.

The turn plate 106 may include a right and left stanchion angle bar 148 and 149 at the top of the turn plate 106 at the trailing edge. The stanchion angle bars 148 and 149 are placed, respectively, on the left and right lateral sides of the of the turn plate 106. The stanchion angle bars 148 and 149 may be secured to the turn plate 106 in a conventional manner. The stanchion angle bars 148 and 149 include an upright stanchion 130, 131, respectively, as best seen in FIG. 5. Each stanchion 130 and 131 is positioned so that the stanchion is at the trailing edge of the turn plate 106 The trailing end of the long board 102 is also attached to the hitch beam 112 in the manner described above. The stanchions 130 and 131 are shown connected to the turn plate 106 through the use of stanchion angle bars 148 and 149, however, the stanchions 130 and 131 may attach to the turn plate 106 through other structures, such as straight bars or circular bases or may attach directly to the turn plate 106.

Figure 4:
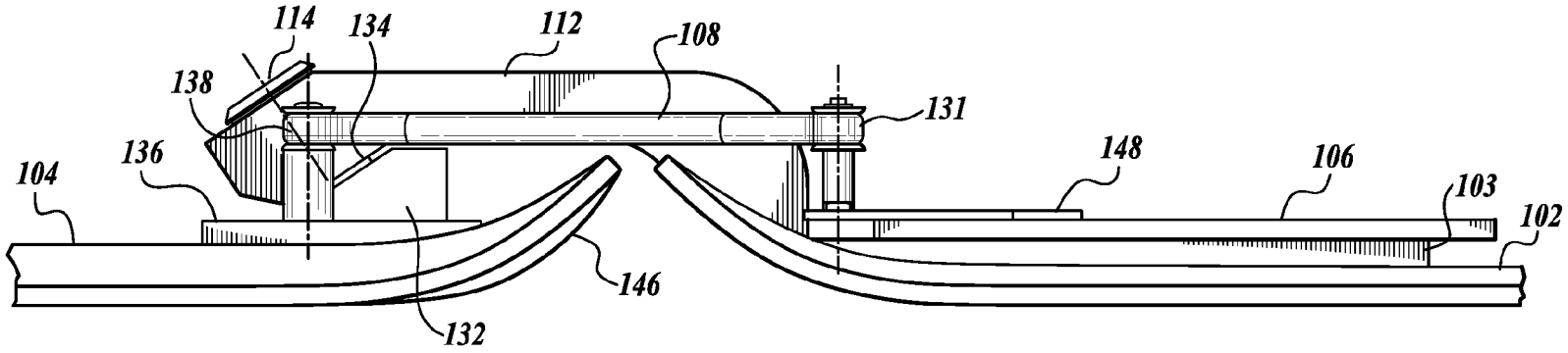
FIG. 4 is a side view illustration of the sliding apparatus of FIG. 1.

The hitch beam 112 connects the trailing end of the long board 102 with the leading end of the short board 104. As seen in FIG. 4, one embodiment of the hitch beam 112 resembles a "C" structure with each of the arms attached to one of the long board 102 and short board 104. While one embodiment of the hitch beam is illustrated, other embodiments may be used, such as a combination of beams. The hitch beam 112 can be fabricated from resin-impregnated fiberglass, or fiberglass with a metal or wood core, for example. The end of the hitch beam 112 connected to the long board 102 is rigidly fixed, i.e., non-rotating and stationary, to the long board 102. However, the end of the hitch beam 112 connected to the short board 104 is attached via an axle 114, and thus, the short board 104 rotates at the axle 114. In some embodiments, the hitch beam 112 is attached on the centerlines of the long board 102 and the short board 104. In some embodiments, the hitch beam 112 is connected to the long board 102 at the trailing edge; however, the connection can be made elsewhere on the long board 102. In some embodiments, the hitch beam 112 is connected to the short board 104 near to the leading edge; however, other embodiments may have the hitch beam connection nearer to the center or even at the center lengthwise of the short board 104.

In some embodiments, the axle 114 has a centerline that intersects with the initiation of the rise in the leading edge of the short board 104. The axle 114 can take many forms. For example, the axle 114 can simply be a screw secured to the axle base 132 on the short board 104, but allows the short board 104 to turn. The axle 114 may be a sleeve bearing and shaft, or the axle 114 may have rotating bearings, such as ball bearings. In any case, the short board 104 is connected to the hitch beam 112 in a manner that allows rotation of the short board 104 at the hitch beam 112. In some embodiments, the axle 114 is placed at an angle with respect to vertical. The axle 114 can make an angle with respect to the vertical from 10 degrees to 75 degrees. In some embodiments, the angle the axle 114 makes with the vertical is from 15 degrees to 60 degrees. In some embodiments, the angle the axle 114 makes with the vertical is from 20 degrees to 45 degrees. In some embodiments, the axle 114 extends at an angle in the direction from the leading end to the trailing end. In other words, the axle 114 top is tilted toward the trailing end of the short board 104 and does not deviate laterally from the longitudinal axis of the short board 104. In some embodiments, the axle 114 is not tilted laterally. However, in some embodiments, the axle 114 may be placed so that the axle 114 also tilts laterally as well as to the rear. From the description provided, other configurations will be possible to envisage.

As a consequence of the axle 114 being at an angle with respect to the vertical, the axle base 132 to which the axle 114 attaches has a complementary angled top surface so that the axle 114 axis and the top surface of the axle base 132 are at 90 degrees. The lower surface 134 of the hitch beam 112 attached to the axle 114 has a similar angled surface to the axle base 132 to lie flat or parallel on the axle base 132 as seen in FIG. 4.

Figure 2:
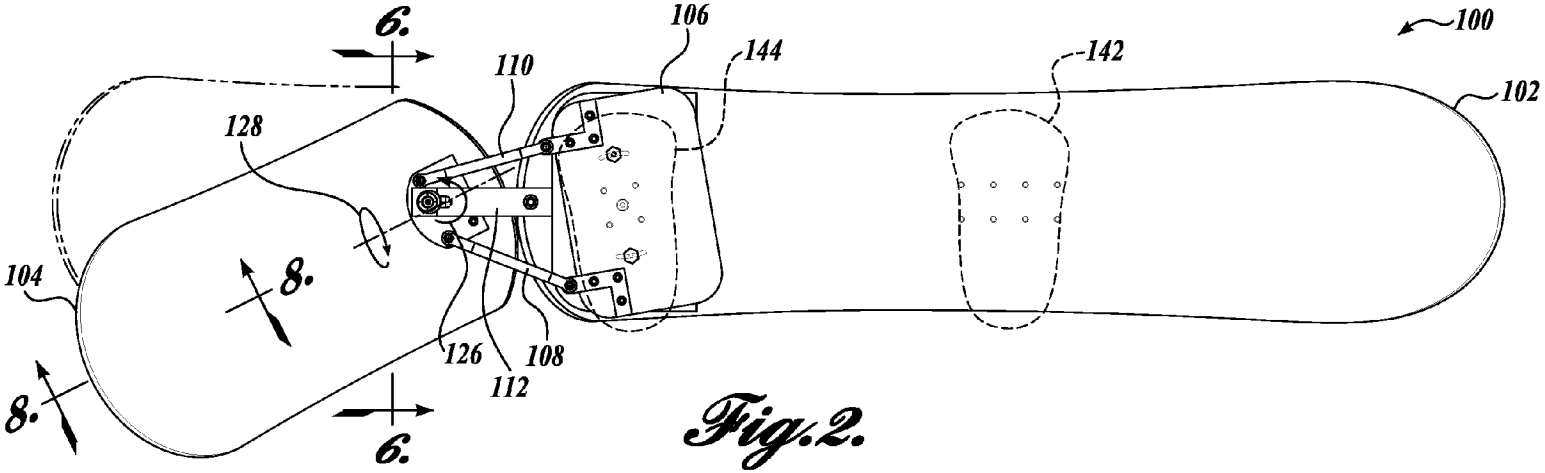
FIG. 2 is an illustration of a sliding apparatus having a long board and a short board with the two boards pivoted relative to each other.
Figure 6:
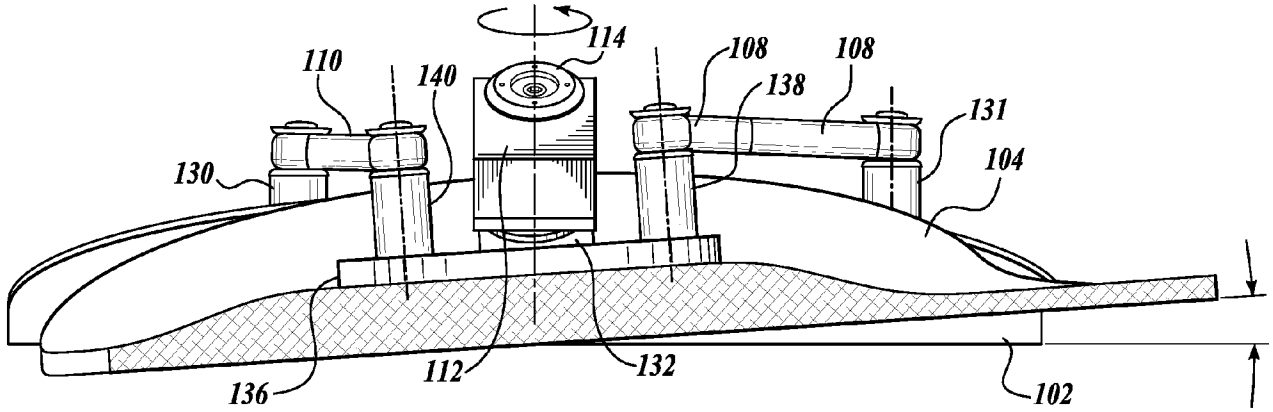
FIG. 6 is a cross-sectional illustration of the sliding apparatus of FIG. 2 taken along lines 6-6 thereof.

Due to the angle of the axle 114, the rotation of the short board 104 about the axle 114 has two directional components. The short board 104 rotates about the axle 114 in the directions indicated by arrows 126 and 128 in FIG. 2. The first component of rotation indicated by arrow 126 is akin to rotation about a vertical axis, as can be seen in FIG. 2 by the movement of the short board 104 to the side. The first component of rotation indicated by arrow 126 can be referred to as a yaw rotation. The second component of rotation indicated by the arrow 128 is akin to rotation about a longitudinal axis as can be seen in FIG. 6 by the movement of the short board 104. The second component of rotation indicated by arrow 128 can be referred to as a roll rotation. A consequence of rotation as indicated by both axes arrows 126 and 128 or a combination of roll rotation with yaw rotation is a rotation of the short board 104 as seen in FIG. 2 combined with lifting of the lateral edge on one side of the short board 104 and a lowering of the lateral edge on the opposite side of the short board 104 as illustrated in FIG. 6. The magnitude of lifting of the edge of the short board 104 (rotation on longitudinal axis) is directly proportional to the degrees from vertical of the axle 114. Conversely, the magnitude of rotation in the horizontal plane (rotation on vertical axis) is inversely proportional to the degrees from vertical of the axle 114. Thus, the angle of the axle 114 can be adjusted to generate the desired magnitude of rotation along the vertical axis and longitudinal axis, i.e., rolling and yawing.

As shown in FIG. 6, as the short board 104 rotates counterclockwise when viewed from the upper surface, the right edge is lifted and the left edge is lowered. Conversely, when the short board 104 rotates clockwise when viewed from the upper surface, the right edge is lowered and the left edge is lifted. That is, lifting of the lateral edge occurs in the direction in which the short board 104 turns. If the short board 104 turns clockwise, the leading clockwise lateral edge is lifted, and if the short board 104 turns counterclockwise, the leading counterclockwise lateral edge is lifted. In this manner, when a rider executes a turn in either direction, it will be the inside edge that is lifted.

Figure 7:
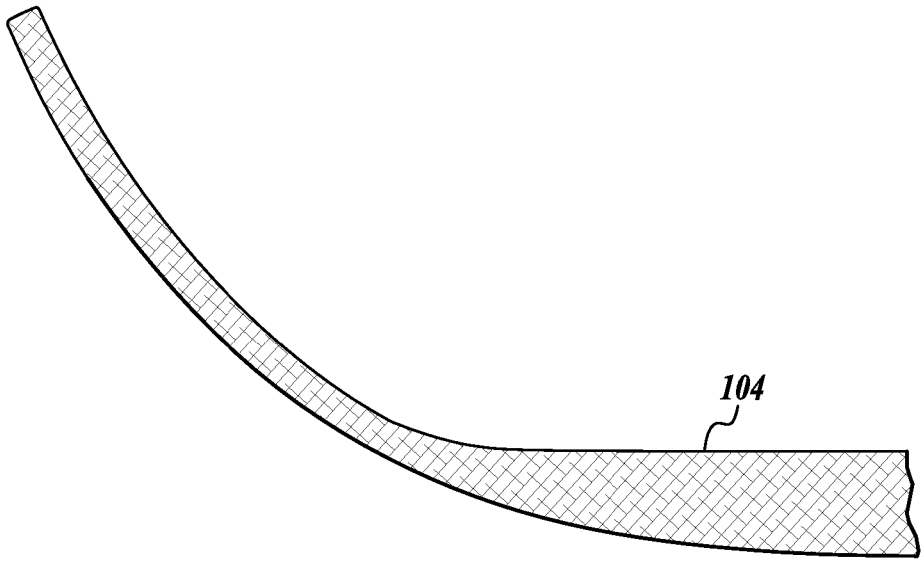
FIG. 7 is a cross-sectional illustration of the sliding apparatus of FIG. 1 taken along lines 7-7 thereof.
Figure 8:
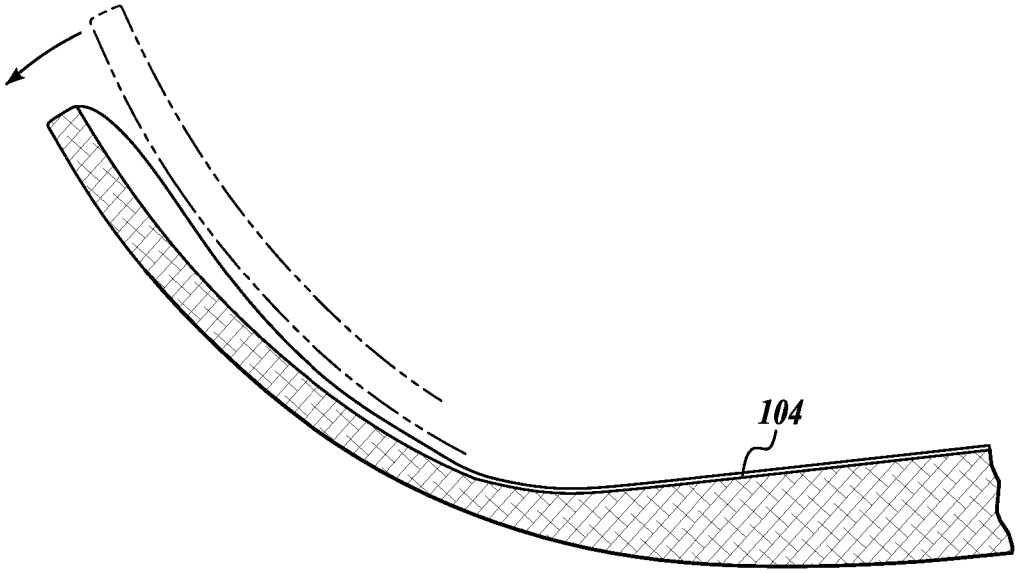
FIG. 8 is a cross-sectional illustration of the sliding apparatus of FIG. 2 taken along lines 8-8 thereof.

FIG. 7 shows a longitudinal cross-section of the short board 104 in the position shown in FIG. 1. FIG. 8 shows that when the short board 104 pivots as shown in FIG. 2, the outside edge of the short board 104 is lowered from the position in FIG. 1. The more rotation there is about the axle 114, the more the edge is either lifted or lowered. The rotation of the short board 104 is controlled by the rotation of the turn plate 106 on the long board 102, since the turn plate 106 is connected to the short board 104 via the arrangement of stanchions 130, 131, 138, 140 and tie rods 108, 110.

Referring to FIG. 4 again, the leading end of the short board 104 includes a stanchion plate 136 fixed rigidly to the upper surface of the short board 104. The stanchion plate 136 can be fiberglass or other rigid material such as steel or aluminum. The stanchion plate 136 includes two upright stanchions 138 and 140 placed respectively on either side of the hitch beam 112 and axle 114. As can be appreciated in FIG. 4, the stanchions 138, 140 on the stanchion plate 136 and the stanchions 130 and 131 on the stanchion angle bars 148 and 149 of the long board 102 are high enough so that tie rods 108 and 110 can clear the up-turned ends of the long board 102 and the short board 104. The tie rods 108 and 110 can be, for example, a rigid metallic rod, for example, steel or aluminum rod. One end of the tie rod 108 is connected to the stanchion 131 on the turn plate 106. The opposite end of the tie rod 108 is connected to the stanchion 138 on the short board 104. Similarly, the tie rod 110 is connected to stanchions 130 and 140, as seen in FIG. 3. One end of the tie rod 110 is connected to the stanchion 130 on the turn plate 106. The opposite end of the tie rod 110 is connected to the stanchion 140 on the short board 104. The connections between the tie rod 108 and the stanchions 131 and 138 are able to rotate and may have some play so that as the short board 104 rotates and the sides of the short board 104 are either lifted or lowered, the tie rod 108 will need to rise or lower at the same time. The connections between the tie rod 110 and the stanchions 130 and 140 are able to rotate and may have some play so that as the short board 104 rotates and the sides of the short board 104 are either lifted or lowered, the tie rod 110 will need to rise or lower at the same time. In some embodiments, the ends of the tie rods 108 and 110 have a collar that rotatably and somewhat loosely fit over the top ends of the stanchions. Then, a screw and washer may hold the collar from disengaging from the stanchion. However, other configurations for attaching the tie rods 108 and 110 to stanchions may be used, such as swivel ball joints. Further, while stanchions and tie rods are shown for connecting the turn plate 106 to the short board 104, other configurations may be envisaged.

As shown in FIG. 3, the tie rods 108 and 110 are not parallel and are placed at an angle with respect to the longitudinal centerlines of the short board 104. The points of attachment of the tie rods 108 and 110 to the short board 104 are generally in-line with the axle 114, and the tie rods 108 and 110 are closely spaced to the axle 114 as seen in FIG. 3. However, from the point of attachment to the short board 104, the tie rods 108 and 110 diverge laterally outward to and are attached at a respectively wider spacing on the long board 102 as seen in FIG. 3. In order to provide a seamless and non-binding rotation of the turn plate 106, the placement of the turn axle 116 and hitch axle 114, and the tie rods' 108 and 110 placement are optimized as shown and described.

In some embodiments, the tie rods 108, 110 may limit the degree of rotation since the tie rods are rigid and cannot extend or bend beyond their initial looseness. While two tie rods are shown connecting the turn plate 106 to the short board 104, other embodiments may include a single bar to connect the turn plate 106 and short board 104. The degree of rotation of the turn plate 106 may also be limited by the length of the sector grooves 120 and 124, since the hold down bolts' shaft will bottom at the ends in the respective sector groove. However, the turn plate 106 can be limited in rotation via other devices.

Referring to FIG. 4, another feature of the short board 104 (or long board 102) is the shape of the underside 146 of the leading end that is fabricated to resemble a bow of a boat. In some embodiments, the short board 104 may include a shallow keel at the leading end on the underside 146 of the short board. In some embodiments, the underside 146 of the leading end of the short board 104 (or long board 102) has a "V" shape. In other embodiments, the underside 146 of the leading end of the short board 104 (or long board 102) has a "spoon" shape. In other embodiments, the underside 146 of the leading end of the short board 104 (or long board 102) can be fabricated to have a hyperbolic curve. The keel or spoon shape can function similar to a fin on a surfboard. That is, the underside 146 on the leading end of the short board 104 can assist in maintaining direction.

In use, the rider stands with both feet on the long board 102, with one foot on a binding 144 (shown in phantom in FIGS. 1 and 2) on the turn plate 106. As demonstrated in FIG. 2, during execution of the turn, the inside edge of the short board 104 (i.e., the right edge) is caused to be lifted in relation to the long boards 102 edge at the same time as the short board 104 is rotated in the direction of turn. The short board 104 acts as a rudder. Rotating the turn plate 106 and, edge weight transfer, or the combination of the two, will affect a directional change. A directional change is enhanced by fore and aft weight changes. The turn plate 106 can be used to maintain direction once the turn is initiated, and augmented by the long board surface contact.

The system allows a rider to increase deviation of the long 102 and short 104 boards from a horizontal plane at the same time that the short board 104, not the long board 102, is caused to deviate from the longitudinal axis of the apparatus. That is, yaw rotation combined with roll rotation of the short board 104, not the long board 102. Accordingly, the rider can tilt or "edge" the short board 104 at the same time that a turn is being implemented.

According, a method of operating the apparatus 100 is disclosed. A method of executing a turn on a sliding apparatus 100 comprising a long board 102 attached to a short board 104, includes during executing a turn on the apparatus, mechanically rotating the short board and mechanically lifting a lateral inside edge of the short board. In some embodiments of the method, clockwise rotation of the short board lifts a clockwise leading lateral edge of the short board. In some embodiments of the method, counterclockwise rotation of the short board lifts a counterclockwise leading lateral edge of the short board. In some embodiments of the method, during executing of a turn, the long board is not caused to mechanically rotate horizontally. In some embodiments of the method, during executing of a turn, no long board edge is caused to mechanically lift.

While illustrative embodiments have been illustrated and described, it will be appreciated that various changes can be made therein without departing from the spirit and scope of the invention.

The embodiments of the invention in which an exclusive property or privilege is claimed are defined as follows:

1. An apparatus for sliding on a surface, comprising:

a long board;

a short board connected to the long board through a hitch beam, wherein the short board is connected to the hitch beam through an axle placed at an angle on the short board, and the long board is connected to the hitch beam through a stationary, non-rotating connection; and a turn plate on the long board, wherein the turn plate is connected to the short board, and the turn plate rotates on the upper surface of the long board causing a corresponding rotation of the short board.

2. The apparatus of claim 1, wherein the turn plate is horizontal to an upper surface of the long board.

3. The apparatus of claim 1, comprising a long board that is about 3 times the length of the short board.

4. The apparatus of claim 1, comprising a long board that is about the same length as the short board.

5. The apparatus of claim 1, further comprising a turn axle connecting the turn plate to the long board.

6. The apparatus of claim 5, further comprising a hold down connection on each lateral side of the turn axle.

7. The apparatus of claim 6, further comprising a sector groove for each hold down connection, wherein the hold down connection is engaged with the sector groove.

8. The apparatus of claim 1, further comprising a first tie rod and a second tie rod that connect the turn plate to the short board.

9. The apparatus of claim 8, further comprising a first and second stanchion on the turn plate and a third and fourth stanchion on the short board, wherein the first tie rod is connected to the first and third stanchions, and the second tie rod is connected to the second and fourth stanchions.

10. The apparatus of claim 1, wherein the short board comprises a leading end having a shallow outward protruding keel shape or spoon shape on the underside thereof.

11. The apparatus of claim 1, wherein the long board has a waist narrower than a leading section and a trailing section of the long board.

12. The apparatus of claim 1, wherein the short board has a waist narrower than a leading section and a trailing section of the short board.

13. The apparatus of claim 1, further comprising a boot binding connected to the turn plate.

14. The apparatus of claim 1, wherein rotation of the short board has a rotation component on a longitudinal axis and a rotation component on a vertical axis.

15. The apparatus of claim 14, wherein a magnitude of the rotation component in the longitudinal axis is dependent on the angle of the axle on the short board.

16. The apparatus of claim 1, wherein the axle is placed at an angle from 15 degrees to 45 degrees from vertical, and the axle is tilted back and along a longitudinal axis of the short board.

17. The apparatus of claim 16, wherein the axle is not tilted laterally from the longitudinal axis of the short board.

18. The apparatus of claim 1, wherein the hitch beam is connected at a trailing side of the long board and the hitch beam is connected to a leading side of the short board.

19. The apparatus of claim 1, wherein clockwise rotation of the short board around the axle lifts a clockwise leading lateral edge of the short board.

20. The apparatus of claim 1, wherein counterclockwise rotation of the short board around the axle lifts a counter clockwise leading lateral edge of the short board.

21. A method of executing a turn on a sliding apparatus comprising a long board attached to a short board, the method comprising:

during executing a turn on the apparatus, mechanically rotating the short board and mechanically lifting a lateral inside edge of the short board.

22. The method of claim 21, wherein clockwise rotation of the short board lifts a clockwise leading lateral edge of the short board.

23. The method of claim 21, wherein counterclockwise rotation of the short board lifts a counterclockwise leading lateral edge of the short board.

24. The method of claim 21, wherein, during executing a turn, the long board is not caused to mechanically rotate horizontally.

25. The method of claim 21, wherein, during executing a turn, no long board edge is caused to mechanically lift.

* * * * *